US008449305B2

(12) United States Patent
Harel et al.

(10) Patent No.: US 8,449,305 B2
(45) Date of Patent: May 28, 2013

(54) MECHANICAL AND ELECTRIC CONNECTION DEVICE FOR A COAXIAL CABLE CONVEYING A HIGH-FREQUENCY SIGNAL

(75) Inventors: Jean-Pierre Harel, Lannion (FR); Patrick Lecam, Lannion (FR); Gérard Jacob, Lannion (FR)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 13/203,355

(22) PCT Filed: Feb. 17, 2010 (Under 37 CFR 1.47)

(86) PCT No.: PCT/FR2010/050267
§ 371 (c)(1), (2), (4) Date: Dec. 9, 2011

(87) PCT Pub. No.: WO2010/097535
PCT Pub. Date: Sep. 2, 2010

(65) Prior Publication Data

US 2012/0244727 A1 Sep. 27, 2012

(30) Foreign Application Priority Data

Feb. 25, 2009 (FR) ..... 09 51193

(51) Int. Cl.
*H01R 12/00* (2006.01)

(52) U.S. Cl.
USPC ..... 439/63

(58) Field of Classification Search
USPC .. 439/63, 581, 578–580, 81, 585, 78; 333/33, 333/260, 34, 245
See application file for complete search history.

(56) References Cited

U.S. PATENT DOCUMENTS

| | | | | |
|---|---|---|---|---|
| 3,662,318 | A | 5/1972 | Decuyper | |
| 4,280,112 | A * | 7/1981 | Eisenhart | 333/21 R |
| 4,799,900 | A * | 1/1989 | Capp et al. | 439/585 |
| 4,906,957 | A * | 3/1990 | Wilson | 333/246 |
| 5,404,117 | A * | 4/1995 | Walz | 333/34 |
| 5,532,659 | A * | 7/1996 | Dodart | 333/260 |
| 5,613,859 | A * | 3/1997 | Bellantoni et al. | 439/63 |

(Continued)

FOREIGN PATENT DOCUMENTS

GB 2 189 652 A 10/1987

OTHER PUBLICATIONS

International Search Report for PCT/FR2010/050267 dated Jun. 18, 2010.

*Primary Examiner* — Alexander Gilman
(74) *Attorney, Agent, or Firm* — Fay Sharpe LLP

(57) ABSTRACT

The present invention concerns a device for the mechanical and electric connection between a multilayer line, including a conductive track and at least one ground plane, and a coaxial cable conveying a high-frequency signal, including an inner conductor and an outer conductor, the mechanical and electric connection device comprising:

means for electrically connecting the coaxial cable to the ground plane of the multilayer line, including a conductive surface arranged opposite the ground plane of the multilayer line from which it is separated by a layer of a dielectric material so as to establish a capacitive electric link between the conductive surface and the ground plane; and a mechanical attachment means including at least one raised pattern that is made of a dielectric material and that can be inserted into a suitable opening formed in the ground plane.

9 Claims, 10 Drawing Sheets

U.S. PATENT DOCUMENTS 5,897,384 A * 4/1999 Hosler, Sr. ..... 439/63
6,065,976 A * 5/2000 Wang ..... 439/63
6,106,304 A * 8/2000 Huang ..... 439/63
6,457,979 B1 * 10/2002 Dove et al. ..... 439/63
6,682,354 B2 * 1/2004 Carson et al. ..... 439/63
6,811,405 B1 * 11/2004 Huang ..... 439/63
6,842,093 B2 * 1/2005 Tamaki et al. ..... 333/260
6,847,276 B2 * 1/2005 Tamaki et al. ..... 333/260
7,008,265 B2 * 3/2006 Jonsson et al. ..... 439/581
7,048,547 B2 * 5/2006 Gottwald ..... 439/63
7,690,922 B2 * 4/2010 Huang ..... 439/63
7,980,894 B1 * 7/2011 Hall et al. ..... 439/585
2002/0000932 A1 1/2002 Metzen et al.

* cited by examiner

MECHANICAL AND ELECTRIC CONNECTION DEVICE FOR A COAXIAL CABLE CONVEYING A HIGH-FREQUENCY SIGNAL

The present invention relates to a device for the mechanical and electric connection between a coaxial cable conveying a high frequency signal and a circuit comprising multilayer microstrip or stripline lines. This mechanical and electric connection device may be part, for example, of a radiofrequency module installed within a base station equipment room.

In the case of a microstrip type configuration, an earthed conductive surface, commonly referred to as the "ground plane", is arranged on one of the faces of a planar dielectric substrate. A conductive track is affixed onto the other face of the dielectric substrate. The microstrip lines usually take the form of a printed circuit lodged on one face of a dielectric substrate, whose opposite, metal-plated, earthed face constitutes the ground plane.

In a stripline type configuration, two continuous earthed conductor plates are arranged in parallel on either side of a conductive track. Each conductor plate is insulated from the conductive track by a dielectric layer.

To ensure electrical continuity between a conductor layer of the earthed coaxial cable on the one hand and the ground plane of a microstrip or stripline line on the other, the system most frequently used consists of a screw and nut on the conductor. Most frequently, the outer conductor of the coaxial cable is soldered onto a conductor element, in turn maintained in electric and mechanical contact with the ground plane of the multilayer line by means of screws, nuts, pins, or any other means suitable to ensure a stable positioning of the junction within a constraining environment. The ground plane can consist of a non-solderable material, such as aluminium. The central inner conductor of the coaxial cable is then soldered to the conductive track of the microstrip or stripline line. The advantage of this solution is that the assembly can be disassembled in the event of repair or replacement of a part. However, this assembly method is complex and costly.

According to an improved solution, it is possible to solder the outer conductor of the coaxial cable on the ground plane of the multilayer line, always provided that its shape is adapted, e.g. by means of cutouts, indentations and/or folding. In that case it is essential that the material of the ground plane be solderable (brass, copper, tin, etc., or metal plating). For this reason, this solution is more expensive, in particular for very large circuits, and can then no longer be disassembled as easily.

The present invention aims to eliminate the drawbacks of the prior art. In particular, the invention proposes a device for the mechanical and electric connection between a coaxial cable conveying a high frequency signal and a multilayer microstrip or stripline line that is inexpensive, easy and quick to implement while ensuring a reliable electrical junction for use in the radiofrequency domain.

The present invention concerns a device for the mechanical and electric connection between a multilayer line, including a conductive track and at least one ground plane, and a coaxial cable conveying a high-frequency signal, including an inner conductor and an outer conductor, the mechanical and electric connection device comprising:

a means for electrically connecting the coaxial cable to the ground plane of the multilayer line, including a conductive surface arranged opposite the ground plane of the multilayer line from which it is separated by a layer of a dielectric material so as to establish a capacitive electrical connection between the conductive surface and the ground plane; and a mechanical attachment means including at least one raised pattern that is made of a dielectric material and that can be inserted into a suitable opening formed in the ground plane.

The mechanical and electric connection device according to the invention enables galvanic isolation by eliminating any direct contact between the different parts acting as the ground plane in a radiofrequency utilisation. The connection between the ground planes takes place by means of capacitive coupling, carried out by placing layers of conductive materials face to face (but not in direct contact). Additionally, the present invention also enables rapid and efficient positioning of the different components of the mechanical and electric connection device.

In the mechanical and electric connection device according to the invention, the conductive surface is electrically connected to the outer conductor.

In a preferred embodiment, the mechanical attachment means include at least one raised pattern that is made of a dielectric material and that can be inserted into a suitable opening formed in the ground plane.

In a first embodiment, the raised patterns are shaped like hooks that enable fast assembly by means of clicking into a suitably sized opening in the ground plane.

According to a second embodiment, the raised patterns are shaped like pins enabling positioning of the mechanical and electric connection device in regard to the ground plane. The mechanical and electric connection device can be attached by means of nuts, bolts and/or rivets made e.g. of plastic.

These mechanical means of attachment have the advantage of being capable of easy disassembly without damage.

The invention also proposes a rapid assembly method for a coaxial cable conveying a high frequency signal and a multilayer line by means of the mechanical and electric connection in accordance with the invention. This method includes the following steps:

the outer conductor of the coaxial cable is connected to the conductive surface of the mechanical and electric connection device, a layer of dielectric material is deposited on the conductive surface of the mechanical and electric connection device, the ground plane of the multilayer line is placed opposite the conductive surface of the mechanical and electric connection device in a manner such as to create a capacitive electrical connection between the conductive surface, which is electrically connected to the outer conductor of the coaxial cable, and the ground plane of the multilayer line, the mechanical and electric connection device is mechanically connected to the ground plane by means of a mechanical attachment element, and the inner conductor of the coaxial cable is connected to the conductive track of the multilayer line.

In a preferred embodiment, the conductive surface of the mechanical and electric connection device is electrically connected to the outer conductor of the coaxial cable by soldering or brazing.

In another preferred embodiment, the mechanical and electric connection device is mechanically connected to the ground plane by means of at least one raised pattern made of a dielectric material and that can be inserted into a suitable opening formed in the ground plane.

In a first embodiment, the mechanical and electric connection device is mechanically connected to the ground plane by means of clicking the raised hook-shaped patterns into a suitable opening formed in the ground plane.

In a second embodiment, the mechanical and electric connection device is mechanically connected to the ground plane by inserting the pin-shaped patterns into a suitable opening formed in the ground plane.

The advantage of the present invention is to enable fast and inexpensive assembly of the pertinent components.

The soldering of the ground plane onto the mechanical and electric connection device is eliminated, and replaced by a capacitive electrical connection. The ground plane can then consist of a not necessarily solderable material, which reduces the cost.

Alternatively, it is also possible to eliminate the use of metal attachment elements (screws, nuts, pins, etc.) for connection with the ground plane. According to the invention, the connection is implemented by means of attachment elements made of dielectric materials. The connection can, in particular, be performed by clicking a raised pattern into place, by pinching with clips, or by means of pins and attachment elements. The method according to the invention enables fast, precise and safe assembly.

Finally, once any direct contact metal-to-metal contact with the ground plane has been eliminated, this type of capacitive electrical connection makes it possible to prevent the occurrence of PIM intermodulation artefacts, which are one of the factors causing signal distortion.

Other characteristics and advantages of the present invention will become apparent in the following description of embodiments, which are given by way of example and not of limitation, and in the attached drawing, in which FIG. 1 depicts a diagram of an example of a junction made by means of a mechanical and electric connection device according to a first embodiment of the present invention;

On FIGS. 3 to 8, identical elements are given the same reference numbers.

FIG. 9 is a perspective view of a third embodiment of the mechanical and electric connection device according to the invention;

FIG. 10 is an exploded perspective view of the components of the mechanical and electric connection device of FIG. 9;

FIG. 11 is an exploded perspective view of the components of the assembly of a coaxial cable to the mechanical and electric connection device of FIG. 9;

FIG. 12 is a perspective view of the assembly of a coaxial cable to the mechanical and electric connection device of FIG. 9;

FIG. 13 is a perspective view of the assembly of FIG. 12 placed on a ground plane;

FIG. 14 is a perspective view of the assembly of FIG. 12 placed between two ground planes;

On FIGS. 9 to 14, identical elements are given the same reference numbers.

Figure 15:
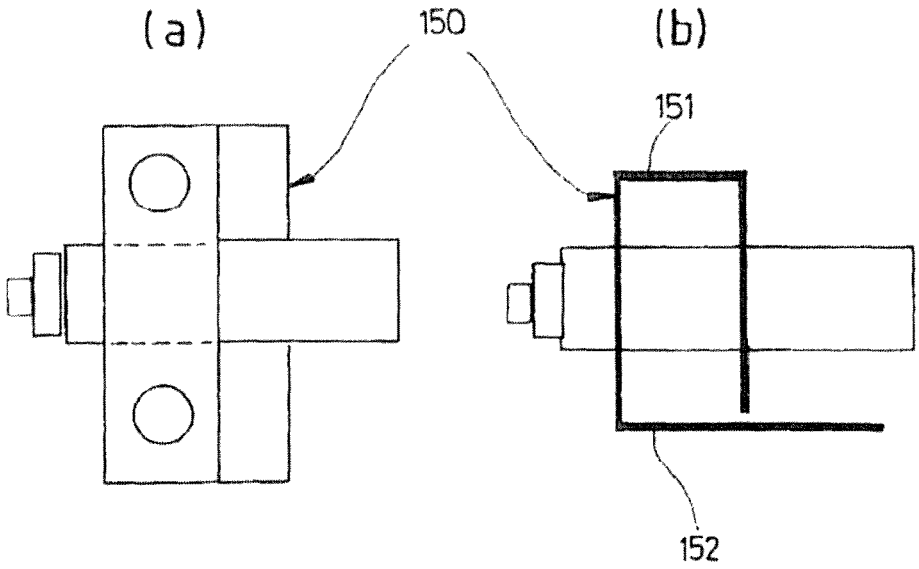
Figure 16:
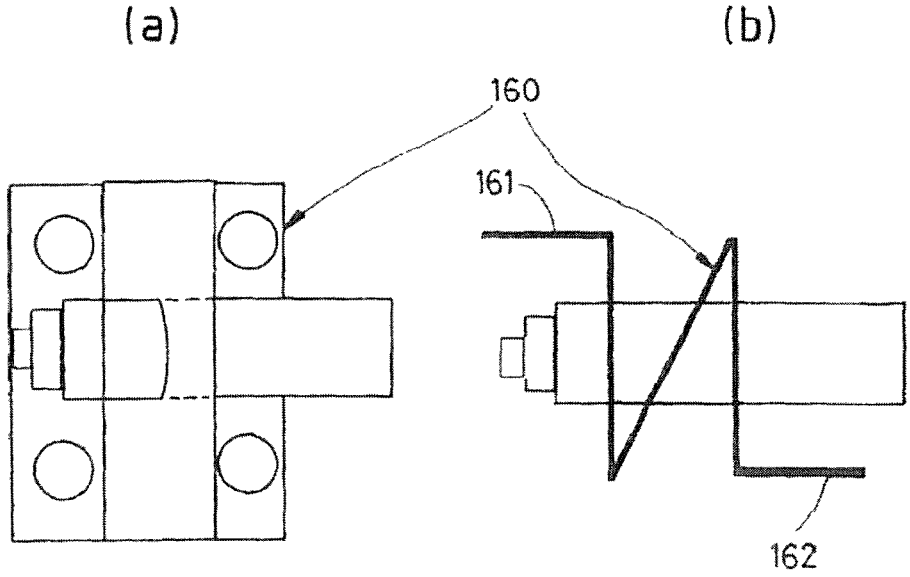
Figure 17:
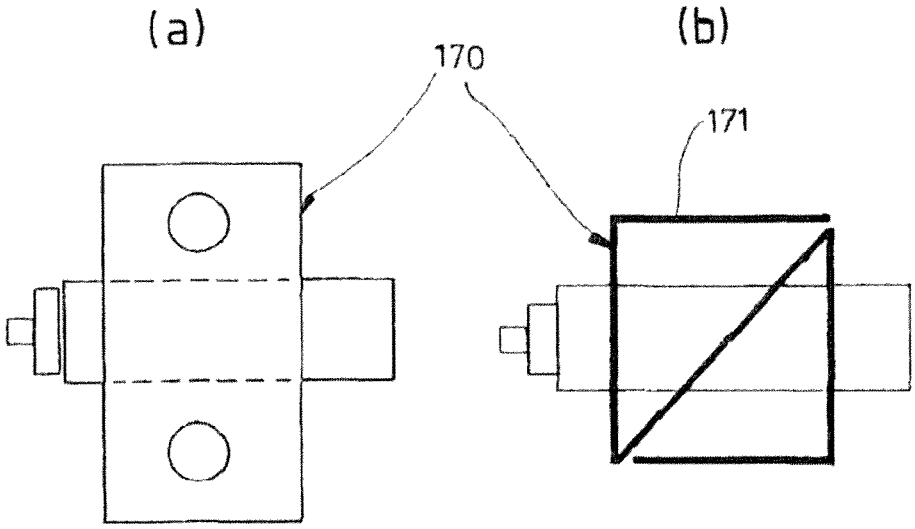
Figure 18:
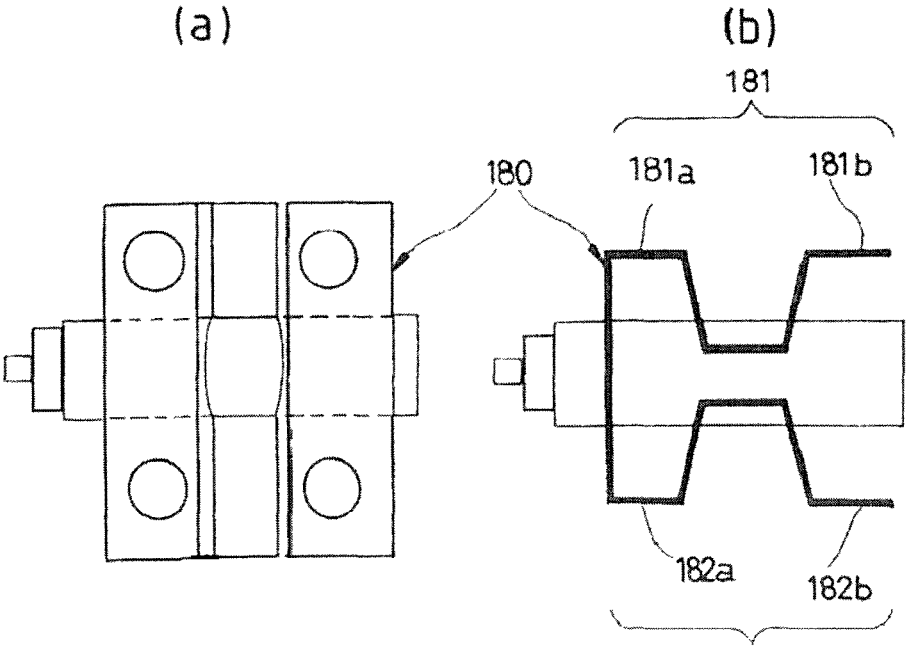
Figure 19:
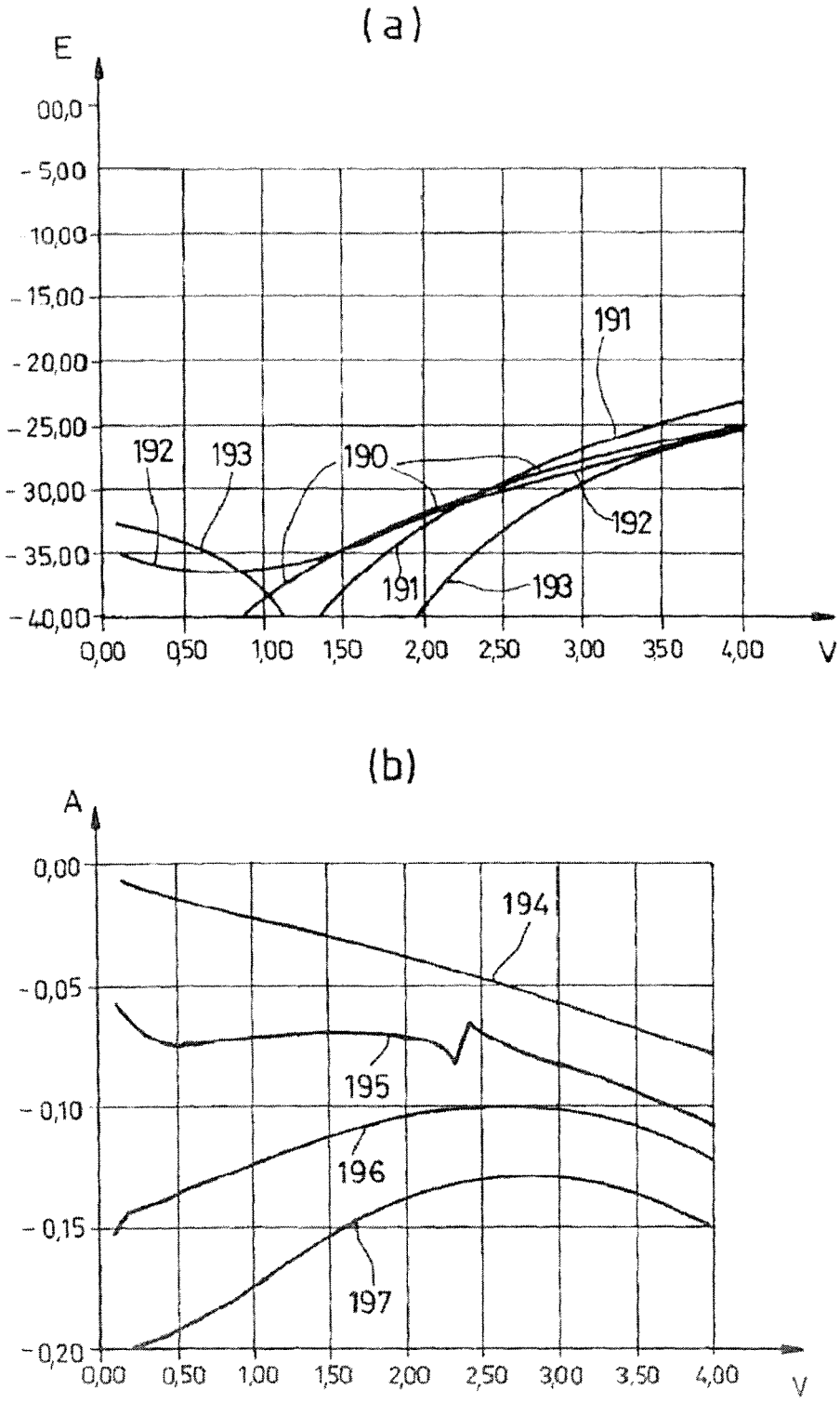

FIGS. 15*a* and 15*b* are, respectively, a top view and a side view of a third embodiment of the mechanical and electric connection device according to the invention;

FIGS. 16*a* and 16*b* are, respectively, a top view and a side view of a fourth embodiment of the mechanical and electric connection device according to the invention;

FIGS. 17*a* and 17*b* are, respectively, a top view and a side view of a fifth embodiment of the mechanical and electric connection device according to the invention;

FIGS. 18*a* and 18*b* are, respectively, a top view and a side view of a sixth embodiment of the mechanical and electric connection device according to the invention;

FIGS. 19*a* and 19*b* show, respectively, the trend in the adaptation of the input impedance E and its insertion loss A, expressed in dB and plotted on the y-axis, as a function of the frequency v between 100 MHz and 4 GHz on the x-axis, for rising values of the thickness of the dielectric layer.

Figure 1:
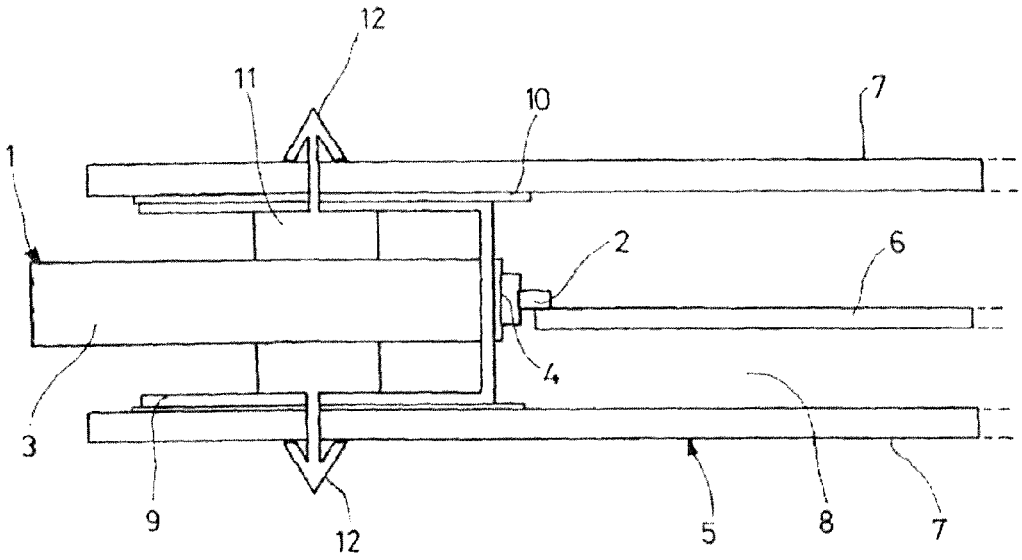
Figure 2:
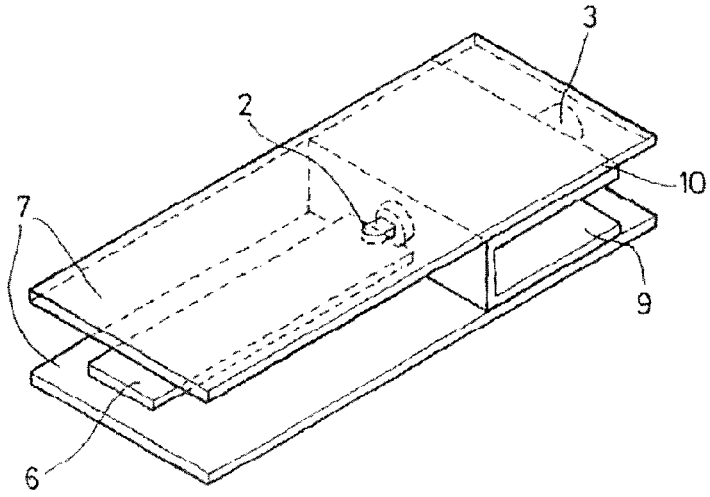
FIG. 2 is a schematic perspective view of the mechanical and electric connection device of FIG. 1.

In the embodiment of a mechanical and electric connection device according to the invention, represented schematically on FIGS. 1 and 2, a coaxial cable 1 comprising a central inner conductor 2 made of metal, an outer conductor 3 receiving alternate current, often implemented as a metal or metal plated braid, and a layer of dielectric material 4 placed between the two conductors 2, 3. Cable 1 is connected to a multilayer stripline 5 comprising a conductive track 6 sandwiched between two conductive surfaces 7. The earthed metal or metal plated conductive surfaces 7 constitute the ground planes of the multilayer line 5. The conductive track 6 is separated from the conductor surfaces 7 placed on either side by a dielectric layer 8, in this case consisting of air, and providing galvanic isolation. the inner conductor 2 of the coaxial cable 1 is electrically connected to the conductive track 6 of the multilayer line 5, e.g. by means of soldering. The mechanical and electric connection device according to a first embodiment of the present invention comprises a conductive connection component 9 in the shape of a U on its side, with the outer face of the branches of the U being covered with a layer of a dielectric material 10 that insulates the connection element 9 from the ground plane 7 in order to avoid any direct metal-to-metal contact. The outer conductor 3 of the coaxial cable 1 is electrically connected to the connection element 9, for example by soldering. The mechanical and electric connection device further comprises an attachment element 11 of a dielectric material comprising, on either side, raised patterns 12 suitable for clicking into openings provided for this purpose in the ground planes 7 in order to ensure, at the same time, the positioning and attachment of the mechanical and electric connection device on the ground planes 7.

Figure 3:
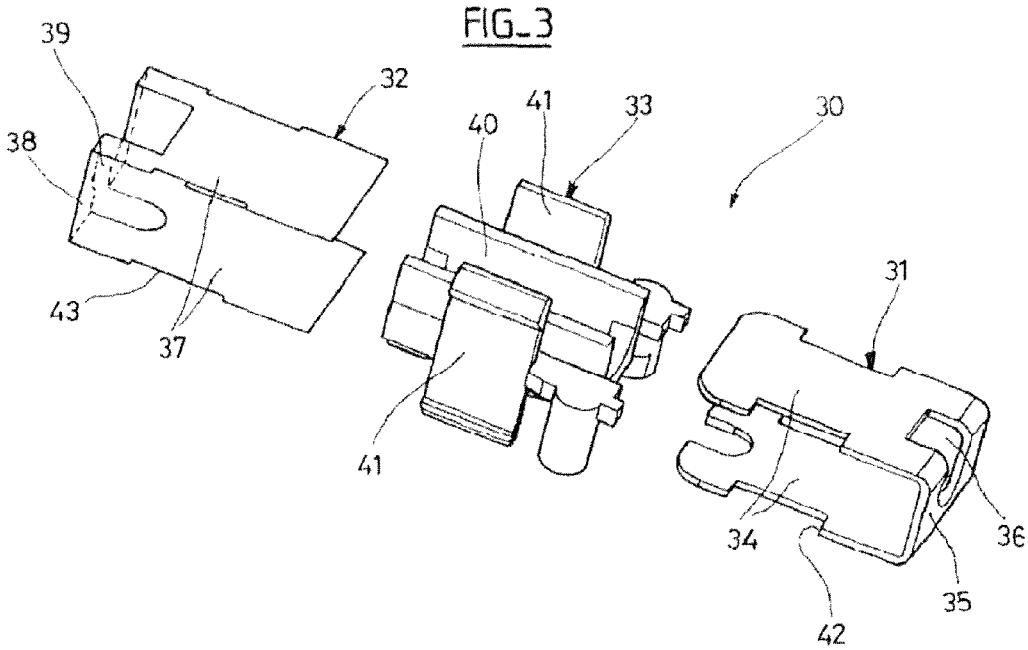
FIG. 3 is a perspective view of a second embodiment of the mechanical and electric connection device according to the invention.
Figure 4:
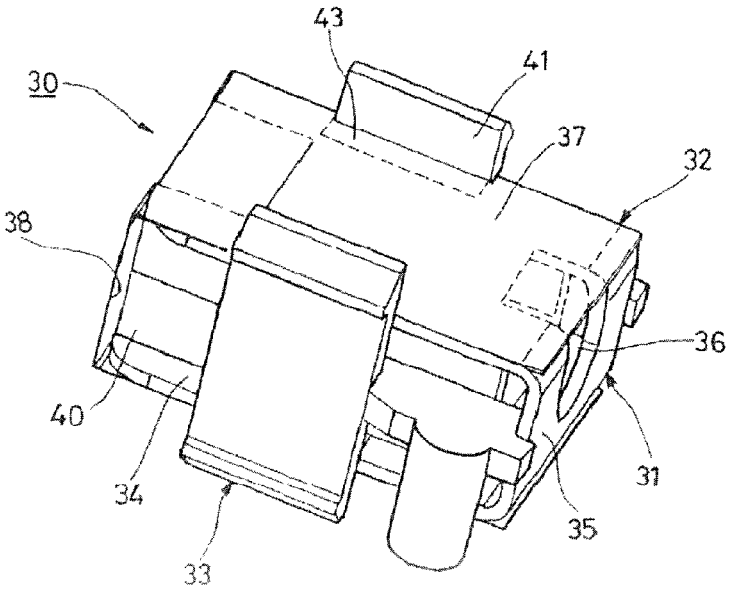
FIG. 4 is an exploded perspective view of the components of the mechanical and electric connection device of FIG. 3.

We shall now examine FIGS. 3 and 4, which depict a second embodiment of the mechanical and electric connection device according to the invention. The mechanical and electric connection device 30 consists of a connection element 31, an insulation element 32 and an attachment element 33.

The connection element 31 is shaped like a U on its side. The connection element 31 is made of a conductive material, such as brass, copper, etc., or else in any other material covered in a conductive material such as tin, silver, gold, etc. The two arms 34 of the U constitute coupling surfaces in regard to a ground plane. The portion 35 located between the two arms 34 of the U comprises an opening 36 intended for the passage of the inner conductor of a coaxial cable.

The insulating element 32 is designed in the shape of a U on its side pointing in the opposite direction of the connection element 31, so as to enable positioning around the connection element 31. The two arms 37 of the insulation element 32 thus respectively cover the two arms 34 of the connection element 31 to constitute a dielectric layer insulating the connection element 31 from the ground planes arranged on either side. Just as for the connection element 31, portion 38 located between the two arms 37 of the U comprises an opening 39 intended for the passage of the coaxial cable. The insulation element 32 is made of a dielectric material such as a polymer like e.g. polyethylene.

The attachment element 33 comprises a core 40 suitable for insertion into the connection element 31, fitted with raised patterns 41 in the shape of hooks projecting upwards and downwards in the direction of the ground planes. Notches 42 and 43 are carried out, respectively, on each edge of the arms 34 of the connection element 31 and the arms 37 of the insulating element 32 to allow passing for the raised patterns 41. Together, by means of a spring effect, the hooks 41 hold the connection element 31 and the insulation element 32. The core 40 is constituted so as to act as a guide and support element for the coaxial cable. The attachment element 33 is made of a dielectric material, e.g. a plastic.

Once the attachment element 33 has been inserted in the connection element 31, with the insulation element 32 covering the system, the mechanical and electric connection device according to this embodiment of the invention is compact as shown in FIG. 4, and has the mechanical resistance required for its function.

Alternatively, the connection element and the attachment element can be carried out as a single piece in a dielectric material, with certain surfaces being covered with metal in order to constitute coupling surfaces.

Alternatively, the insulation element can be reduced to an insulation film deposited on the conductive surfaces, always provided that effective insulation is provided between the conductive surface and the ground plane located opposite. It is, for example, possible to glue a sheet of dielectric material on each conductive surface.

Figure 5:
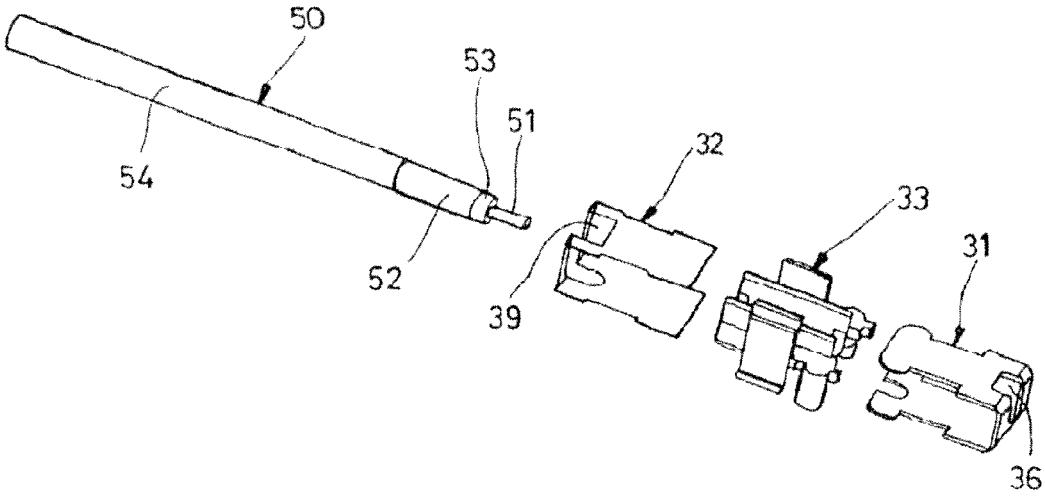
FIG. 5 is an exploded perspective view of the components of the assembly of a coaxial cable to the mechanical and electric connection device of FIG. 3.
Figure 6:
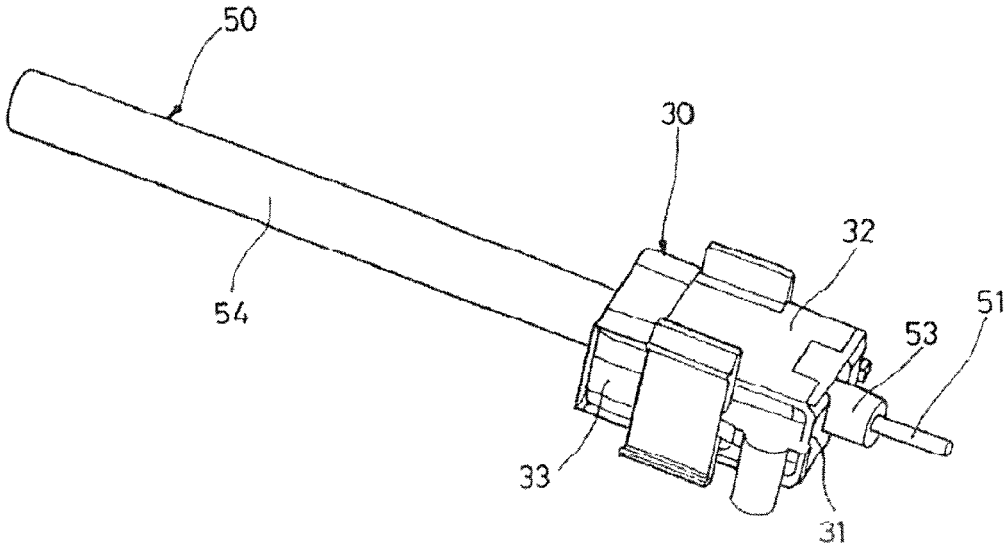
FIG. 6 is a perspective view of the assembly of a coaxial cable to the mechanical and electric connection device of FIG. 3.

FIGS. 5 and 6 show how the mechanical and electric connection device represented in FIGS. 3 and 4 engages with a coaxial cable 50 comprising an inner conductor 51 and an outer conductor 52 separated by a dielectric layer 53, wherein the system is protected by an insulation cladding 54 made of a dielectric material such as polyethylene (PE) or polytetrafluoroethylene (PTFE). The cable 50 enters the mechanical and electric connection device by the opening 39 of the insulation element 32. The cable 50 is guided by the attachment element 33 placed inside the connection element 31, so that the inner conductor 51 surrounded by the dielectric layer 53 exits via the opening 36 of the connection element 31.

For the implementation of a connection between a coaxial cable 50 and a multilayer line, the first step is to establish an electrical continuity between the outer conductor 52 of the cable 50 and the connection element 31, for example by soldering, allowing the inner conductor 51 to protrude through the opening 36. By sliding along the cable 50, the attachment element 33 is then inserted into the connection element 31 by positioning the raised patterns 41 of the attachment element 33 into the notches 42 of the connection element 31. Finally, the insulation element 32 is slipped over the cable via the opening 39, and slid so as to cover the connection element 31, the notches 43 of the connection element 31 fitting onto the raised patterns 41 of the attachment element 33.

It is now only necessary to join the coaxial cable 50 fitted with its mechanical and electric connection device to the multilayer line. In the case of a stripline, the first step is to click in two hooks 41 of the attachment element 33 into openings provided for this purpose in the first of the two ground planes of the stripline. The inner conductor 51 of the coaxial cable 50 is then electrically connected to the conductive track of the stripline. Finally, the other two hooks 41 of the attachment element 33 are clicked into openings provided for this purpose in the second of the two ground planes of the stripline.

Figure 7:
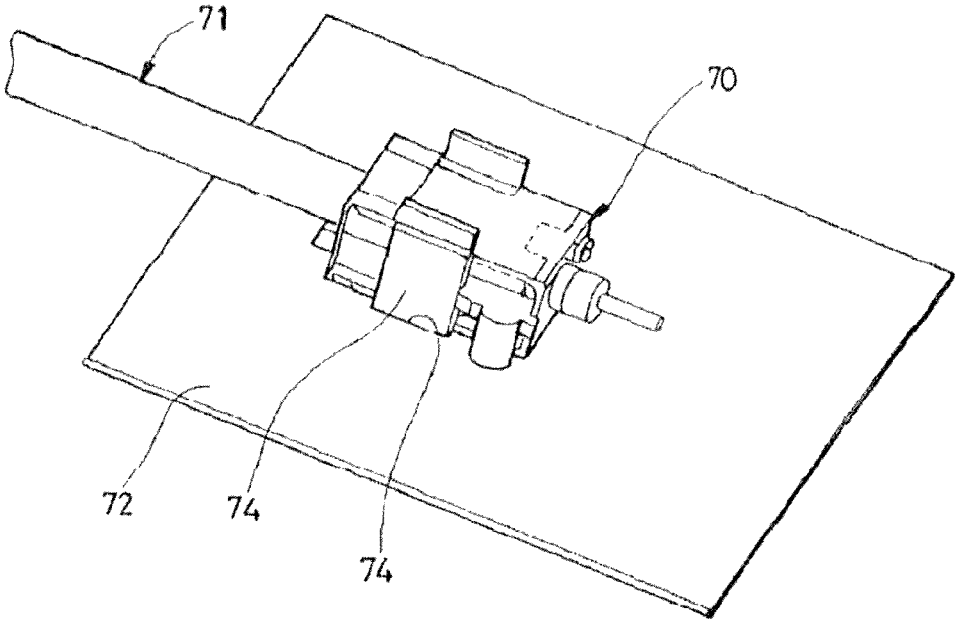
FIG. 7 is a perspective view of the assembly of FIG. 6 placed on a ground plane.

FIG. 7 represents a mechanical and electric connection device according to the embodiment shown in FIGS. 3 to 6, in position, attached to a ground plane of a multilayer type microstrip line. The mechanical and electric connection device 70, enclosing a coaxial cable FIG. 71 is set on a conductive surface 72 constituting the ground plane of a multilayer type microstrip line. The raised patterns 73 of the attachment element are inserted into openings 74 of the ground plane and hold it by a spring effect to maintain the mechanical and electric connection device in contact with the ground plane.

Figure 8:
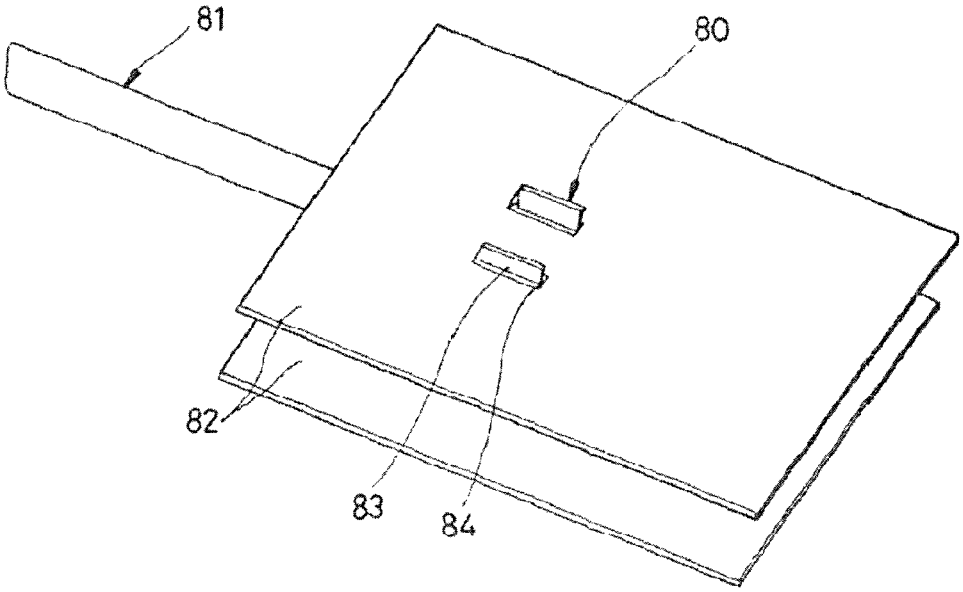
FIG. 8 is a perspective view of the assembly of FIG. 6 placed between two ground planes.

FIG. 8 represents a mechanical and electric connection device according to the embodiment shown in FIGS. 3 to 6, in position, attached to a ground plane of a multilayer type stripline. The mechanical and electric connection device 80, enclosing a coaxial cable 81 is set between two conductive surfaces 82 constituting the ground planes of a multilayer type stripline. The hook-shaped raised patterns 83 of the attachment element are inserted into openings 84 of the ground plane and hold it by a spring effect to maintain the mechanical and electric connection device in contact with the two ground planes on either side.

It is of course possible to connect several cables in the same way, where each cable is provided with its own mechanical and electric connection device, to one and the some multilayer line.

Figure 9:
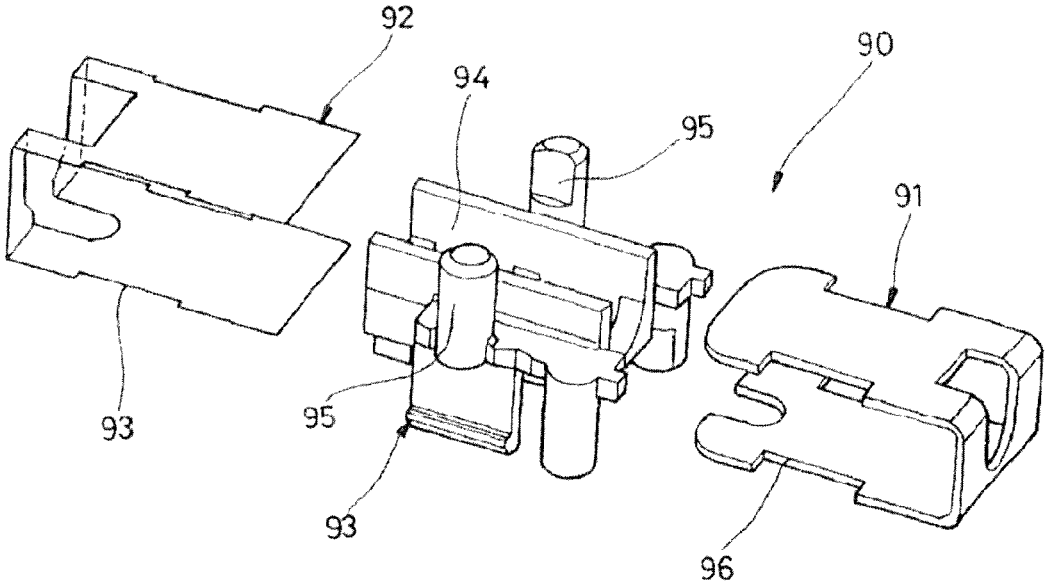
Figure 10:
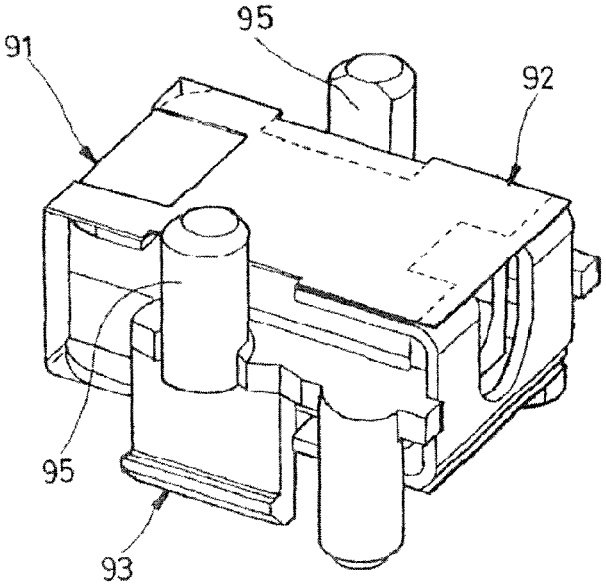

We shall now examine FIGS. 9 and 10, which depict a third embodiment of the mechanical and electric connection device according to the invention. The mechanical and electric connection device 90 consists of a connection element 91, an insulation element 92 and an attachment element 93. This third embodiment differs from the second embodiment in that the attachment element 93 comprises a core 94 suitable for insertion into the connection element 91, fitted with raised patterns 95 in the shape of pins intended to ensure the positioning of the mechanical and electric connection device 90 in regard to the ground planes. Notches 96 and 97 are created, respectively, on the connection element 91 and on the insulation element 92 to allow passage of the positioning pins 95.

Figure 11:
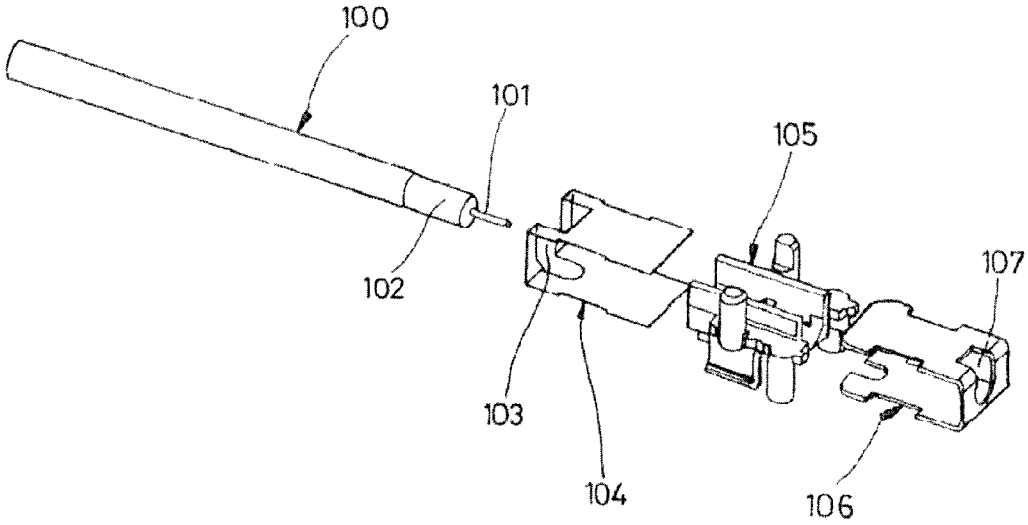
Figure 12:
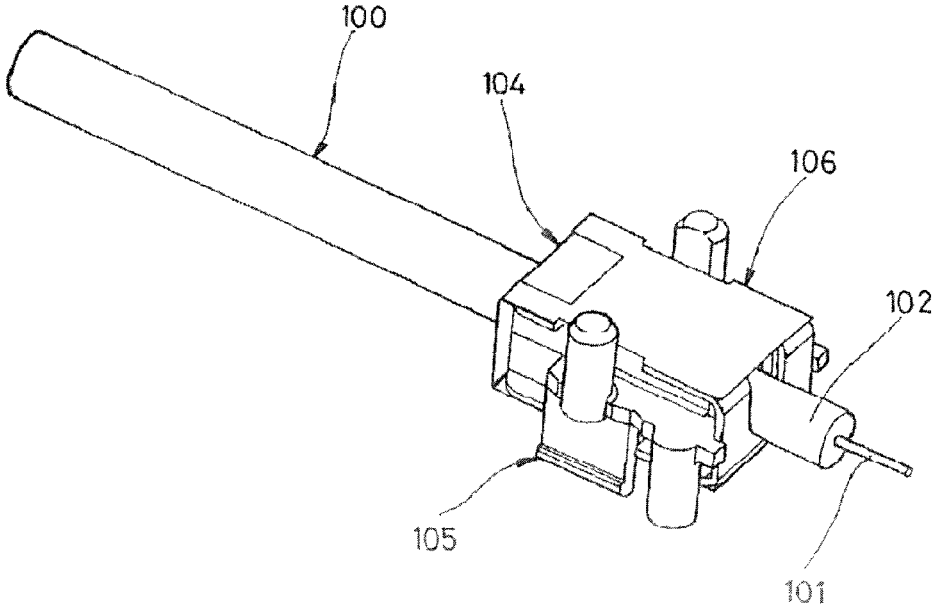

FIGS. 11 and 12 show how the mechanical and electric connection device represented in FIGS. 9 and 10 engages with a coaxial cable 100 comprising an inner conductor 101 and an outer conductor 102. The cable 100 enters the mechanical and electric connection device by the opening 103 of the insulation element 104. The cable 100 is guided by the attachment element 105 placed inside the connection element 106, no that the inner conductor 101 exits via the opening 107 of the connection element 106.

Figure 13:
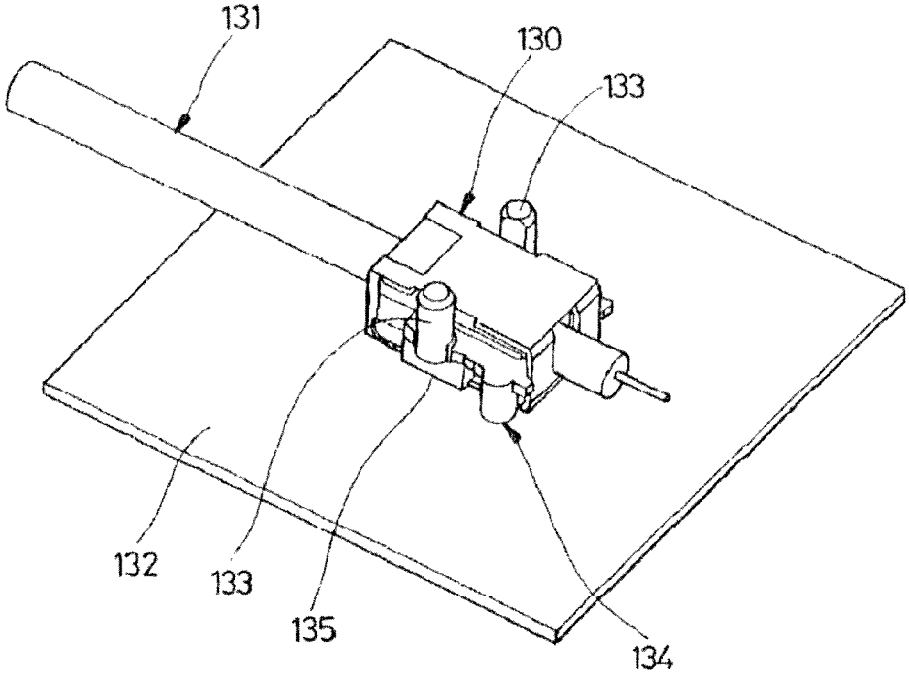

FIG. 13 represents a mechanical and electric connection device according to the embodiment shown in FIGS. 9 to 12, in position, attached to a ground plane of a multilayer type microstrip. The mechanical and electric connection device 130, enclosing a coaxial cable FIG. 131, is set on a conductive surface 132 constituting the ground plane of a multilayer type microstrip. The raised patterns 133, forming positioning pins, of the attachment elements 134, are inserted into the openings 135 of the ground plane.

Figure 14:
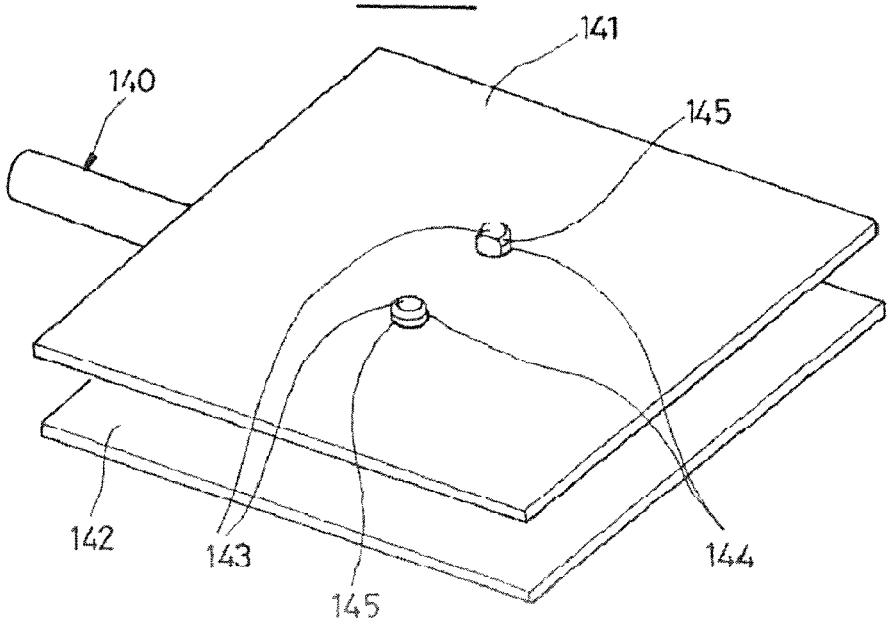

FIG. 14 represents a mechanical and electric connection device according to the embodiment shown in FIGS. 9 to 12, in position, attached to a ground plane of a multilayer type stripline. The mechanical and electric connection device, enclosing a coaxial cable 140, is set between two conductive surfaces 141, 142 constituting the ground planes of a multilayer type stripline. The pins 143 of the attachment element of the mechanical and electric connection device are inserted into the openings 144 of the ground plane. The junction of the coaxial cable 140 fitted with its mechanical and electric connection device with the stripline: the first step is to insert two positioning pins 143 of the attachment element into openings 144 provided for this purpose in the first of the two ground planes of the stripline. The inner conductor of the coaxial cable 140 is then electrically connected to the conductive track of the stripline. Finally, the other two positioning pins 143 of the attachment element are inserted into openings provided for this purpose in the second of the two ground planes of the multilayer line. The bilateral attachment of the mechanical and electric connection device to the two ground planes is ensured by means of nuts 145 made of a dielectric material.

FIGS. 15*a* to 18*b* represent differently shaped variants of the connection element.

FIGS. 15*a* and 15*b* show an embodiment variant according to which the connection element 150 presents the form of a P on its side, presenting two surfaces 151 and 152 for capacitive coupling with the ground planes located above and below the mechanical and electric connection device.

FIGS. 16*a* and 16*b* show an embodiment variant according to which the connection element 160 presents the form of an N extended by two surfaces 161 and 162 turned towards the outside for capacitive coupling with the ground planes located above and below the mechanical and electric connection device.

FIGS. 17*a* and 17*b* show an embodiment variant according to which the connection element 170 presents the form of an N extended by two surfaces 171 and 172 turned towards the inside for capacitive coupling with the ground planes located above and below the mechanical and electric connection device.

FIGS. 18*a* and 18*b* show an embodiment variant according to which the connection element 180 presents the form of an anvil on its side, open at one end and presenting two surfaces 181 and 182, each consisting of two portions 181*a*, 181*b* and 182*a*, 182*b* respectively, for capacitive coupling with the ground planes located above and below the mechanical and electric connection device.

FIG. 19*a* represents the trend in the adaptation of the input impedance E of the junction in relation to an impedance of 50 Ohms, for increasing values of the thickness of a polyethylene layer. The adaptation of the input impedance E varies between −40 dB and 0 dB on the radiofrequency range 0.1 GHz to 4 GHz, at a constant capacitive coupling surface for the two ground planes, i.e. 2 (20×15)=600 $mm^2$. The curve 190 acts as a reference and relates to the case where the ground planes are in direct electrical contact. Curves 191, 192 and 193 show the changes for thicknesses of 0.1 mm, 0.2 mm and 0.3 mm respectively.

FIG. 19*b* represents the insertion loss A as a function of the frequency v for rising values of the thickness of a dielectric polyethylene layer. The insertion loss A varies between −0.20 dB and 0 dB at a constant capacitive coupling surface for two ground planes, i.e. 2 (20×15)=600 $mm^2$. The curve 194 acts as a reference and relates to the case where the ground planes are in direct electrical contact. Curves 195, 196 and 197 show the trend for 0.1 mm, 0.2 mm and 0.3 mm thicknesses respectively, on the 0.1 GHz to 4 GHz radiofrequency range.

The curve shows that the capacitive coupling will be the more efficient the thinner the dielectric layer. Of course, the optimum thickness of the dielectric layer depends on the dielectric constant of the material used. It is also known that the capacitive coupling will be the more efficient the greater the coupling surface. The thickness of the dielectric layer and the coupling surface must be optimised as a function of the working frequency range, more particularly of the central frequency and the scope of the frequency band.

Naturally, the present invention is not limited to the described embodiments, but is, rather, subject to many variants accessible to the person skilled in the art without departing from the spirit of the invention. In particular, it will be possible, without leaving the scope of the invention, to modify the form of the mechanical and electric connection device as well as the form of the raised pattern(s) of the mechanical attachment means.

The invention claimed is:

1. Device for the mechanical and electric connection between a multilayer line, including a conductive track and at least one ground plane, and a coaxial cable conveying a high-frequency signal, including an inner conductor and an outer conductor, the mechanical and electric connection device comprising a means for electrically connecting the coaxial cable to the ground plane of the multilayer line, including a conductive surface arranged opposite the ground plane of the multilayer line from which it is separated by a layer of a dielectric material so as to establish a capacitive electric link between the conductive surface and the ground plane; and a mechanical attachment means including at least one raised pattern that is made of a dielectric material and that can be inserted into a suitable opening formed in the ground plane.

2. Mechanical and electric connection device according to claim 1, wherein the conductive surface is electrically connected to the outer conductor of the coaxial cable.

3. Mechanical and electric connection device according to claim 1, wherein the raised pattern is shaped in the form of a hook enabling assembly by means of snapping into place.

4. Mechanical and electric connection device according to claim 1, wherein the raised pattern is shaped in the form of a pin enabling positioning.

5. Method for the mechanical and electric connection of a coaxial cable, comprising an inner and an outer conductor, with a multilayer line, comprising a conductive track and at least one ground plane, by means of a mechanical and electric connection device comprising electrical connection means between the coaxial cable and the ground plane of the multilayer line comprising a conductive surface arranged opposite the ground plane of the multilayer line, from which it is separated by a layer or dielectric material, and mechanical attachment means comprising at least one raised pattern made of a dielectric material and that can be inserted into a suitable opening formed in the ground plane, said method comprising:

connection of the outer conductor of the coaxial cable to the conductive surface of the mechanical and electric connection device, deposit of a layer of dielectric material onto the conductive surface of the mechanical and electric connection device, placement of the ground plane of the multilayer line opposite the conductive surface of the mechanical and electric connection device in a manner such as to create a capacitive electrical connection between the conductive surface, which is electrically connected to the outer conductor of the coaxial cable, and the ground plane of the multilayer line, mechanical connection of the mechanical and electric connection device to the ground plane by means of a mechanical attachment, and connection of the inner conductor of the coaxial cable to the conductive track of the multilayer line.

6. Mechanical and electric connection method according to claim 5, wherein the conductive surface of the mechanical and electric connection device is electrically connected to the outer conductor of the coaxial cable by soldering or brazing.

7. Mechanical and electric connection method according to claim 5, wherein the mechanical and electric connection device is mechanically connected to the ground plane by means of at least one raised pattern made of a dielectric material and that can be inserted into a suitable opening formed in the ground plane.

8. Mechanical and electric connection method according to claim 7, wherein the mechanical and electric connection device is mechanically connected to the ground plane by means of clicking at least one raised hook-shaped pattern made of a dielectric material into a suitable opening formed in the ground plane.

9. Mechanical and electric connection method according to claim 7, wherein the mechanical and electric connection device is mechanically connected to the ground plane by means of the insertion of at least one pin-shaped raised pattern made of a dielectric material into a suitable opening formed in the ground plane.

* * * * *